US010186771B2

(12) United States Patent
Bowden et al.

(10) Patent No.: US 10,186,771 B2
(45) Date of Patent: Jan. 22, 2019

(54) OPTICALLY-ACTIVATED ARRAY UTILIZING PHOTONIC INTEGRATED CIRCUITS (PICS)

(71) Applicant: RAYTHEON COMPANY, Waltham, MA (US)

(72) Inventors: James M. Bowden, Forney, TX (US); Timothy R. Holzheimer, Rockwall, TX (US)

(73) Assignee: RAYTHEON COMPANY, Waltham, MA (US)

( * ) Notice: Subject to any disclaimer, the term of this patent is extended or adjusted under 35 U.S.C. 154(b) by 97 days.

(21) Appl. No.: 15/289,926

(22) Filed: Oct. 10, 2016

(65) Prior Publication Data

US 2017/0104269 A1 Apr. 13, 2017

Related U.S. Application Data

(60) Provisional application No. 62/240,499, filed on Oct. 12, 2015.

(51) Int. Cl.
*H01Q 3/26* (2006.01)
*H01Q 1/22* (2006.01)
(Continued)

(52) U.S. Cl.
CPC ..... *H01Q 3/2676* (2013.01); *H01Q 1/2283* (2013.01); *H01Q 1/36* (2013.01); *H01Q 1/48* (2013.01); *H01Q 21/24* (2013.01)

(58) Field of Classification Search
CPC ..... H01Q 3/2676; H01Q 1/2283; H01Q 1/36; H01Q 1/48
See application file for complete search history.

(56) References Cited

U.S. PATENT DOCUMENTS 4,736,463 A * 4/1988 Chavez ..... H01Q 3/34 342/367
6,208,293 B1 * 3/2001 Adams ..... G02B 6/4295 342/368

(Continued)

OTHER PUBLICATIONS

Ji, Y. et al., "Spatial Optical Signal Processing Multibeam Array Antennas for Both Transmission and Reception", IEE, 10th International Conference on Antennas and Propagation, Apr. 14-17, 1997, pp. 1.494-1.497, Conference Publication No. 436.

(Continued)

*Primary Examiner* — Hoang Nguyen
(74) *Attorney, Agent, or Firm* — Lewis Roca Rothgerber Christie LLP

(57) ABSTRACT

A photonic integrated circuit. The photonic integrated circuit includes: a plurality of antenna elements, an element of the plurality of antenna elements having an electrical port and including: a first laser configured to produce laser light of a first wavelength; and a first radiative patch conditionally connected to the electrical port and connected, by an optical connection, to the laser, the first radiative patch including, as a major component, a semiconductor material configured to be conductive when illuminated by light having the first wavelength, and to be nonconductive when not illuminated, the first radiative patch being configured, when conductive, to convert an electric signal received at the electrical port to radiated electromagnetic waves, or to convert received electromagnetic waves to an electrical signal at the electrical port.

13 Claims, 9 Drawing Sheets

(51) Int. Cl.

| | |
|---|---|
| ***H01Q 1/48*** | (2006.01) |
| ***H01Q 1/36*** | (2006.01) |
| ***H01Q 21/24*** | (2006.01) |

(56) References Cited

U.S. PATENT DOCUMENTS 6,426,721 B1 * 7/2002 Obara ..... H01Q 3/2676 342/372
2012/0328298 A1 * 12/2012 Yi ..... H01Q 3/2676 398/96

OTHER PUBLICATIONS

Lee, J. J. et al., "Photonic Wideband Array Antennas", IEEE Transactions on Antennas and Propagation, Sep. 1995, pp. 966-982 , vol. 43, No. 9.
Liu, D. et al., "Structurally Embedded Photoconductive Silicon Bowtie Antenna", IEEE Photonics Technology Letters, May 1998, pp. 716-718 , vol. 10, No. 5.
Seeds, A.J. et al., "Optical Control of Phased Array Antennas: A European Perspective", IEEE MTT-S Digest, 1990, pp. 1343-1346.
Vanblaricum, Michael L., "Photonic Antenna Reconfiguration: A Status Survey", Proceedings of the SPIE, Photonics and Radio Frequency II, Jul. 21-22, 1998, pp. 180-189, San Diego, California.

* cited by examiner

OPTICALLY-ACTIVATED ARRAY UTILIZING PHOTONIC INTEGRATED CIRCUITS (PICS)

CROSS-REFERENCE TO RELATED APPLICATION(S)

The present application claims priority to and the benefit of U.S. Provisional Application No. 62/240,499, filed Oct. 12, 2015, entitled "OPTICALLY-ACTIVATED ARRAY UTILIZING PHOTONIC INTEGRATED CIRCUITS (PICS)", the entire content of which is incorporated herein by reference.

FIELD

One or more aspects of embodiments according to the present invention relate to antennas, and more particularly to array antennas having elements that may be optically activated.

BACKGROUND

Photo-conductive antennas activated by laser pulses (or continuous wave (CW) laser light) may include antenna elements fabricated from a photo-conductive semiconductor material that becomes conductive when illuminated by a light source. When the laser source is turned off, the photo-conductive antenna elements become non-conductive. In the non-conductive state the antenna elements cannot transmit or receive electromagnetic waves.

Light may be fed to such antennas by arrays of optical fibers, which may be cumbersome. Moreover, such an antenna may have little flexibility to accommodate different frequencies of operation. Thus, there is a need for an improved optically activated antenna.

SUMMARY

Aspects of embodiments of the present disclosure are directed toward a photonic integrated circuit. The photonic integrated circuit may include an antenna element including one or more patches of photoconductive material, that, when illuminated, become conductive, to act as radiative patches. The photonic integrated circuit may further include a laser configured to illuminate the patches through a waveguide, and a photonic switch for making a connection between an RF port of the antenna element and the one or more patches of photoconductive material when the laser is illuminated. In operation, the antenna element may be activated by turning on the laser, and deactivated by turning off the laser, rendering it transparent to electromagnetic waves.

According to an embodiment of the present invention there is provided a photonic integrated circuit, including: a plurality of antenna elements, an element of the plurality of antenna elements having an electrical port and including: a first laser configured to produce laser light of a first wavelength; and a first radiative patch conditionally connected to the electrical port and connected, by an optical connection, to the laser, the first radiative patch including, as a major component, a semiconductor material configured to be conductive when illuminated by light having the first wavelength, and to be nonconductive when not illuminated, the first radiative patch being configured, when conductive, to convert an electric signal received at the electrical port to radiated electromagnetic waves, or to convert received electromagnetic waves to an electrical signal at the electrical port.

In one embodiment, the optical connection includes a waveguide coupled to an optical output of the first laser, and the first radiative patch is on, and parallel to, a first portion of the waveguide.

In one embodiment, the first portion of the waveguide includes a grating configured to reflect light out of a plane of the waveguide and toward the patch.

In one embodiment, the photonic integrated circuit includes a photonic switch on the waveguide, the photonic switch being configured to conditionally connect the first radiative patch to the electrical port.

In one embodiment, the photonic integrated circuit includes, as a major component, a semiconductor material configured to be conductive when illuminated by light having the first wavelength, and nonconductive when not illuminated.

In one embodiment, the photonic integrated circuit includes a photonic coupler on the waveguide, the photonic coupler being configured to conditionally connect the first radiative patch to the electrical port, wherein the photonic coupler includes a conditionally conductive path including, as a major component, a semiconductor material configured to be conductive when illuminated by light having the first wavelength, and nonconductive when not illuminated.

In one embodiment, the photonic integrated circuit includes a second radiative patch, the first radiative patch and the second radiative patch together forming a bowtie antenna.

In one embodiment, the photonic integrated circuit includes: a second laser configured to produce laser light of a second wavelength; and a second radiative patch conditionally connected to the electrical port, the second radiative patch including, as a major component, a semiconductor material configured to be conductive when illuminated by light having the second wavelength, and to be nonconductive when: illuminated by light having the first wavelength, or not illuminated.

In one embodiment, the photonic integrated circuit includes a third radiative patch and a fourth radiative patch, wherein: the first radiative patch and the third radiative patch form, when conductive, a bowtie antenna of a first size, and the first radiative patch, the second radiative patch, the third radiative patch, and the fourth radiative patch form, when conductive, a bowtie antenna of a second size larger than the first size.

In one embodiment, a stacked antenna includes: a first array antenna including a first photonic integrated circuit; and a second array antenna including a second photonic integrated circuit, the second array antenna being stacked parallel to the first array antenna.

In one embodiment, the first array antenna is configured to operate at a first frequency and the second array antenna is configured to operate at a second frequency, higher than the first frequency.

In one embodiment, the stacked antenna includes a ground plane, parallel to the first array antenna and to the second array antenna.

In one embodiment, a separation between the ground plane and the first array antenna is one quarter of a wavelength corresponding to the first frequency, and a separation between the ground plane and the second array antenna is one quarter of a wavelength corresponding to the second frequency.

According to an embodiment of the present invention there is provided an optically configurable array antenna including; a transparent substrate including: a plurality of radiative patches; and a plurality of vias each forming a conductive path through the transparent substrate to a respective radiative patch of the plurality of radiative patches; a microlens array below the transparent substrate; a plurality of lasers, arranged in an array below the microlens array, the microlens array being configured to direct light from each of the plurality of lasers to a respective radiative patch of the plurality of radiative patches; a nonconductive substrate below the plurality of lasers, the nonconductive substrate including a plurality of spring-loaded pins; and an integrated circuit, including: a plurality of laser drive circuits, each of the laser drive circuits being configured to provide drive current for a respective laser of the plurality of lasers; and a plurality of transmit receive modules, each of the transmit receive modules being configured to provide drive current for, or receive a signal from, a respective radiative patch of the plurality of radiative patches, the integrated circuit being connected to the plurality of lasers through a first subset of the spring-loaded pins, and the integrated circuit being connected to the plurality of radiative patches through a second subset of the spring-loaded pins.

In one embodiment, the radiative patches are arranged on a rectangular grid.

In one embodiment, the radiative patches are arranged on a triangular grid.

In one embodiment, each of the radiative patches is rectangular.

In one embodiment, the nonconductive substrate includes, as a major component, polytetrafluoroethylene.

In one embodiment, the microlens array includes, as a major component, silicon dioxide.

In one embodiment, a laser of the plurality of lasers is a vertical cavity surface emitting laser.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of exemplary embodiments of an optically-activated array utilizing photonic integrated circuits provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1A:
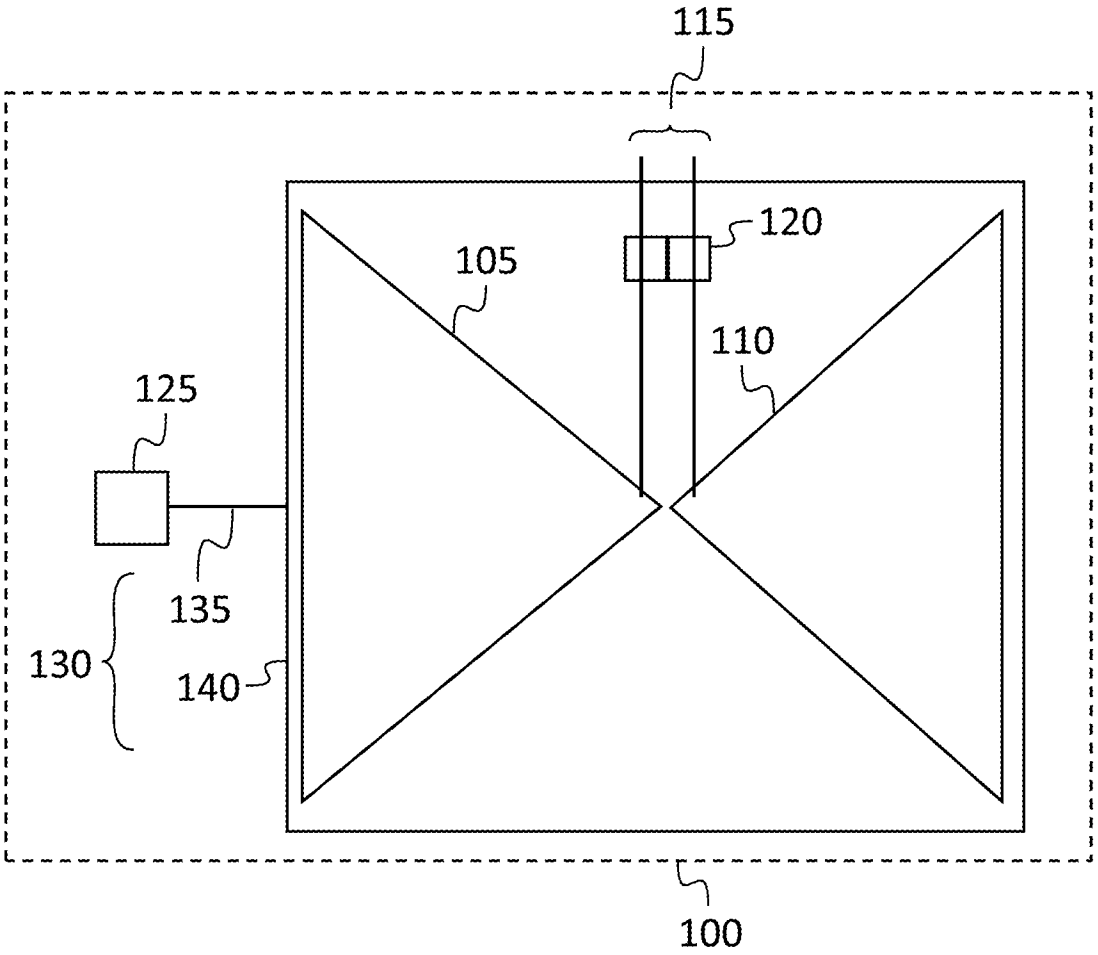
FIG. 1A is a schematic plan view of an antenna element, according to an embodiment of the present invention.

Referring to FIG. 1A, in one embodiment, an antenna element 100 includes a first radiative patch 105, a second radiative patch 110, a radio frequency (RF) port 115, and a photonic switch 120, or a photonic coupler. The RF port 115 may include two conductors configured as a balanced transmission line (e.g., a pair of parallel conductors, or a pair of parallel conductors over a ground plane, forming a differential microstrip transmission line) for carrying RF signals received by the antenna element 100 or to be transmitted by the antenna element 100. The conductors may be composed of copper or gold, or carbon nanotubes. The photonic switch 120 may include two switching elements, each having the function of a single-pole single-throw switch, establishing, when turned on, a conductive through path for one of the two conductors. As such, the photonic switch 120 may operate as two ganged single-pole single-throw switches, so that when both are closed, each of the conductors of the RF port 115 is connected to a respective conductor leading to one of the two radiating patches 105, 110.

The two radiative patches 105, 110 may be triangles together forming a bowtie antenna as shown. The term "radiative patch" is used herein to include both a patch suitable for radiating (i.e., converting guided waves from a transmission line to electromagnetic radiation propagating in free space) and a patch suitable for receiving (i.e., converting electromagnetic radiation propagating in free space to guided waves in a transmission line). As used herein "radio frequency" or "RF" refers to any frequency suitable for being radiated or received by the antenna element, and may include, for example, microwave or millimeter wave frequencies. As used herein, the term "conditionally connected" means connected through an element, such as a switch, that, depending on its state, determines whether a connection is made. For example, in the embodiment of FIG. 1A, the two radiative patches 105, 110 are conditionally connected to the RF port 115, as a result of being connected to the RF port 115 through the photonic switch 120. In other embodiments the patches may be any arbitrary shape.

Each of the two radiative patches 105, 110 may be composed of a photoconductor, e.g., a semiconductor material that may act as an insulator when not illuminated, and that may act as a conductor when illuminated with light having a photon energy greater than the band gap of the semiconductor material. Such a material may act as a conductor as a result of absorbed photons creating electron-hole pairs in the semiconductor material, the electrons and/or holes then being capable of carrying current through the material. A laser 125 may act as a light source, to cause the two radiative patches 105, 110 to become conductive when the laser is illuminated, and to be nonconductive otherwise. The laser may produce pulsed light or continuous wave (CW) light.

The switching elements of the photonic switch 120 may also be composed of a photoconductor, and in some embodiments they are composed of the same semiconductor material as the two radiating patches 105, 110, and illuminated by the same light source (e.g., by the laser 125), so that when the light source is activated, the photonic switch 120 is turned on and the two radiating patches 105, 110 are made conductive. The laser may be a 980 nm InGaAs laser, and the two radiating patches 105, 110 may be composed of silicon, with a band gap of 1.1 eV. As used herein, an element or path is "conditionally conductive" if the element is conductive or nonconductive, depending on its state. Accordingly, the two radiating patches 105, 110 are conditionally conductive. The photoconductive switches may also be photonic couplers. In some embodiments the laser wavelength is 1310 nm or 1510 nm.

Figure 1B:
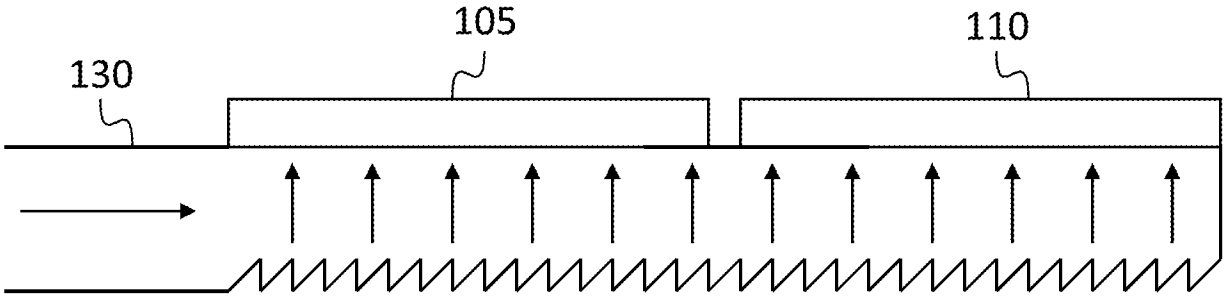
FIG. 1B is a schematic side view of a portion of an antenna element, according to an embodiment of the present invention.

A waveguide 130 (e.g., a $SiN_x$ low-loss waveguide) may guide the light produced by the laser to the two radiative patches 105, 110. In one embodiment, the waveguide has a narrow portion 135 connecting the laser to a wide portion 140, the wide portion extending below both of the two radiative patches 105, 110 and the photonic switch 120. Referring to FIG. 1B, the lower surface of the waveguide may include a grating 145 (e.g., a diffraction grating having a blaze angle of 45 degrees) for changing the direction of propagation of the light from being in the plane of the waveguide, to being perpendicular to the waveguide, propagating, e.g., toward the two radiative patches 105, 110 and the photonic switch 120 (not shown in FIG. 1B).

The components of FIGS. 1A and 1B may be fabricated in a photonic integrated circuit, e.g., by photolithographic processes, deposition processes, and the like. As a result, each antenna element may include a laser on the photonic integrated circuit, making it unnecessary to supply light to the antenna, e.g., over an array of optical fibers. The photonic integrated circuit of FIGS. 1A and 1B may be fabricated for example on one side, which may be referred to as the "front" side, of a glass substrate (or of a substrate composed of another material). Additional structures may be fabricated on the other side of the substrate, which may be referred to as the "back" side of the substrate. These additional structures may include, for example, modulators, demodulators, and additional waveguides, that may provide communication links for sending data to or from the elements on the front side of the substrate. Feedpoint connections between elements on the front side of the substrate and those on the back side may be made with through glass vias.

Figure 2:
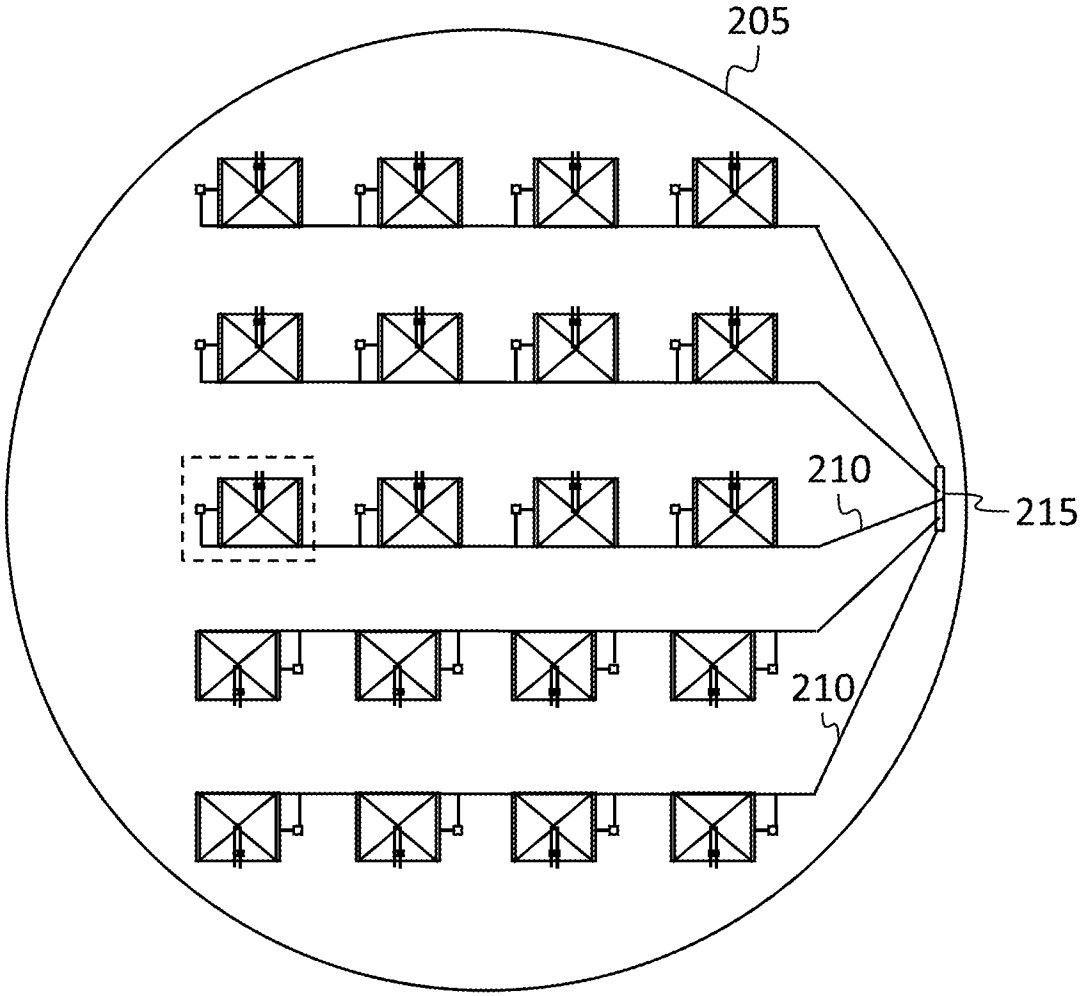
FIG. 2 is a schematic plan view of an array antenna, according to an embodiment of the present invention.

Referring to FIG. 2, a plurality of the antenna elements 100 of FIG. 1 may be fabricated on a single photonic integrated circuit 205 (which may be formed on one wafer) as shown. The RF port of each antenna element 100 may be connected to a feed network (not shown in FIG. 2) that distributes outgoing RF signals or collects received RF signals, or both. The lasers 125 may be powered and controlled by a laser power and control network 210 that may be connected to an external control circuit through an interface 215.

Figure 3:
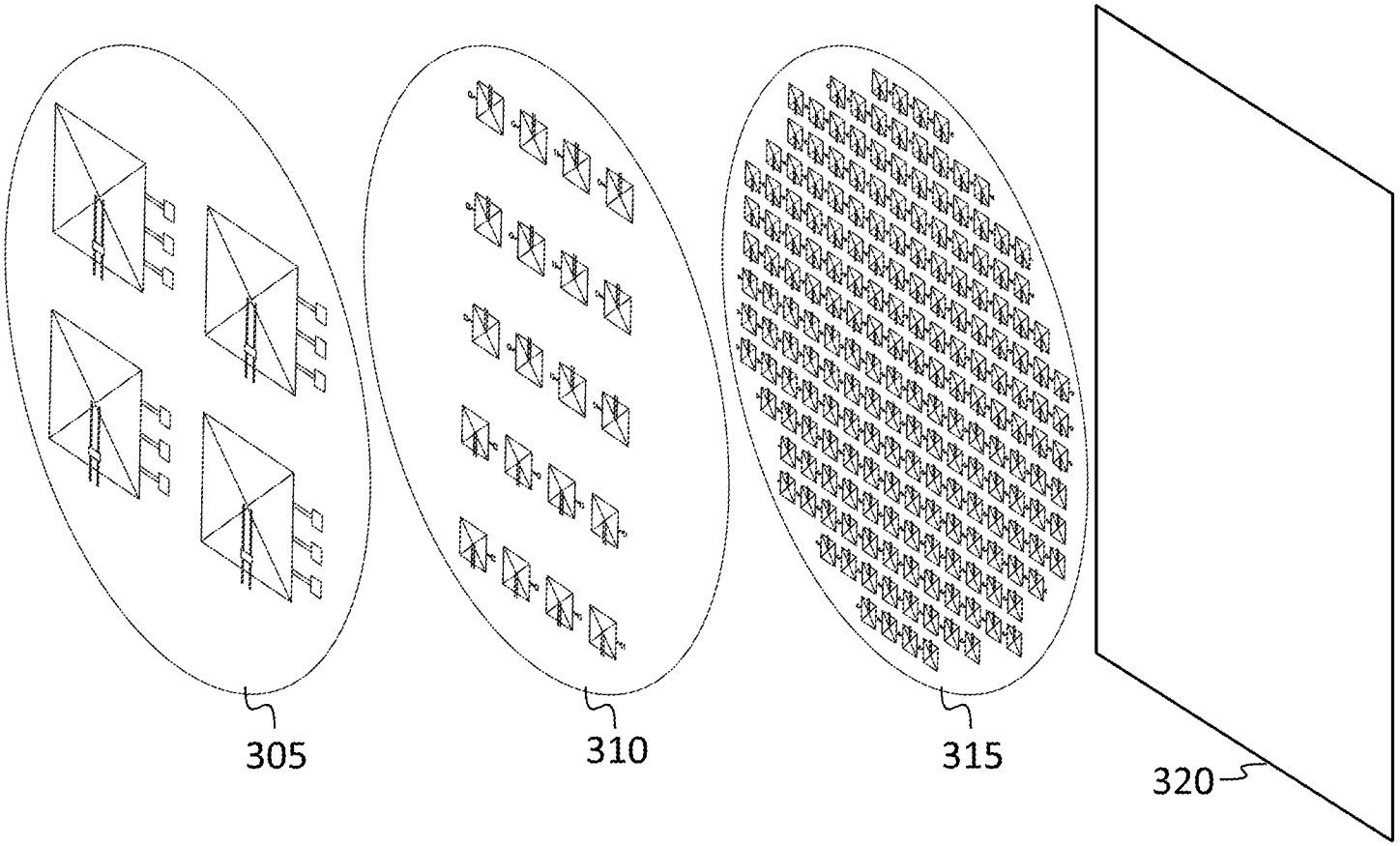
FIG. 3 is a schematic exploded perspective view of a stacked array antenna, according to an embodiment of the present invention.

Referring to FIG. 3, in some embodiments, a plurality of photonic integrated circuits such as that illustrated in FIG. 2 may be stacked to form, for example, an antenna capable of operating at several different frequencies. For example, a first photonic integrated circuit 305 may be configured to operate at a first RF frequency, a second photonic integrated circuit 310 may be configured to operate at a second RF frequency, and a third photonic integrated circuit 315 may be configured to operate at a third RF frequency. Each of these photonic integrated circuit may have antenna elements having a size, and an element-to-element spacing, selected according to the respective frequency of operation. In some embodiments the lasers in the respective photonic integrated circuits may operate at the same wavelength; in others they may operate at different wavelengths. The ability, in the embodiment of FIG. 3, to activate or "fire up" the photonic integrated circuits independently or together may make it possible to cover extremely wide instantaneous RF frequency bands.

In operation, one of the photonic integrated circuits may be activated, e.g., the lasers in the photonic integrated circuit may be turned on, and RF signals may be supplied to the antenna elements on the photonic integrated circuit so that it operates to transmit or receive RF electromagnetic waves. Any other photonic integrated circuit in front of the activated photonic integrated circuit (i.e., in the direction in which the activated photonic integrated circuit is transmitting or in the direction from which the activated photonic integrated circuit is receiving) may be deactivated, i.e., the lasers in the other photonic integrated circuit may be turned off, so that the radiative patches 110 of the antenna elements 100 of the other photonic integrated circuit are nonconductive and therefore do not interfere with the operation of the activated photonic integrated circuit. In some embodiments, all of the other photonic integrated circuits in the stack, other than the activated photonic integrated circuit, may be deactivated so that the activated photonic integrated circuit may radiate both through any photonic integrated circuits in front of it and through any photonic integrated circuits behind it (or to avoid the effects that conducting patches, even if not in the path of the transmitted or received radiation, may have on the radiation pattern of the activated photonic integrated circuit).

In some embodiments a ground plane 320 may be included behind the stack, and each photonic integrated circuit of the stack may be spaced from the ground plane so that electromagnetic waves reflected from the ground plane will interfere constructively with electromagnetic waves transmitted or received by the other side of the photonic integrated circuit. In some embodiments this is accomplished by separating each of the photonic integrated circuits from the ground plane by a distance of one-quarter of the wavelength corresponding to the respective frequency of operation of the photonic integrated circuit (i.e., a distance equal to one-quarter of the speed of light divided by the respective frequency of operation). In some embodiments a plurality of photonic integrated circuits such as that illustrated in FIG. 2 may similarly be stacked and configured to transmit or receive electromagnetic waves of different polarizations.

Figure 4:
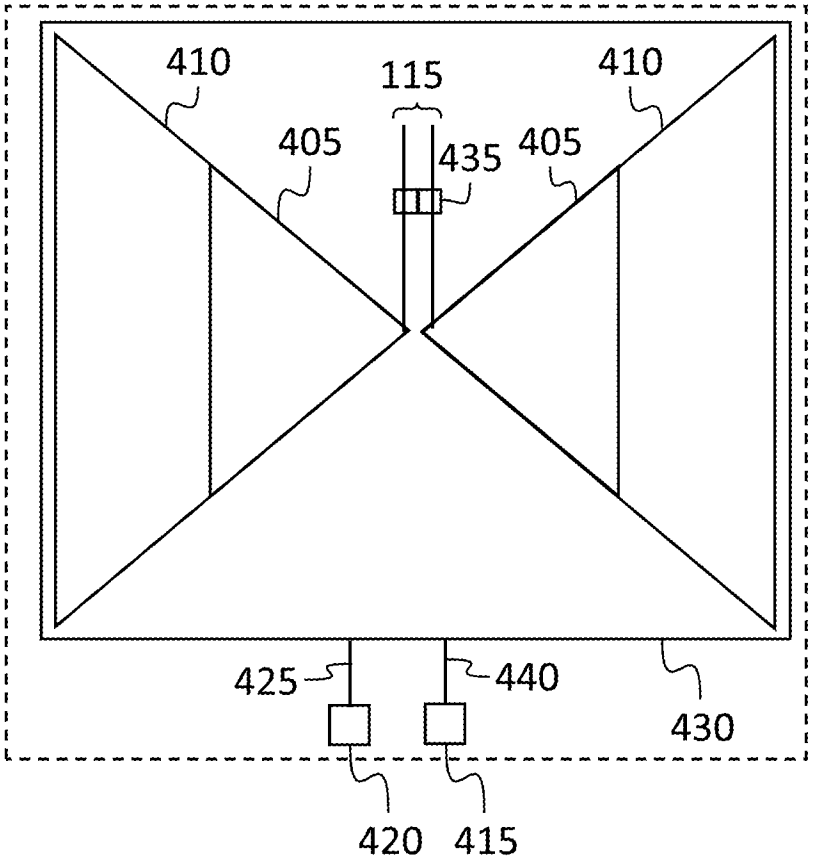
FIG. 4 is a schematic plan view of an antenna element, according to an embodiment of the present invention.

Referring to FIG. 4, in one embodiment an antenna element includes a first plurality of radiative patches 405 (e.g., triangular patches) composed of a first semiconductor having a first band gap (e.g., silicon (Si) with a band gap of 1.1 eV) and a second plurality of radiative patches 410 (e.g., trapezoidal patches, or patches that are isosceles trapezoids) composed of a second semiconductor having a second band gap (e.g., silicon (GaAs) with a band gap of 1.43 eV). The antenna element may include first laser 415 configured to emit light at a first wavelength (e.g., 980 nm) corresponding to a photon energy of more than the first band gap and less than the second band gap, and a second laser 420 configured to emit light at a second wavelength (e.g., 657 nm) corresponding to a photon energy of more than the second band gap. As in the embodiment of FIGS. 1A, 1B, and 2, each of the lasers 415, 420 may be coupled to the radiative patches 405, 410 by a waveguide. The waveguide may have a first narrow portion 425 connecting the first laser 415 to a wide portion 430, the wide portion extending below all four of the radiative patches 405, 410 and below a photonic switch 435, and a second narrow portion 440 connecting the second laser 420 to the wide portion 430. As in the embodiment of FIGS. 1A, 1B, and 2, the wide portion 430 may include, on its lower surface, a grating for changing the direction of propagation of the light from being in the plane of the waveguide, to being perpendicular to the waveguide, propagating, e.g., toward the four radiative patches 405, 410 and the photonic switch 435. The photonic switch 435 may be similar to the photonic switch 120 and may include two switching elements each composed of the first semiconductor.

In operation, the photonic switch may be turned on, and the first plurality of radiative patches 405 may be conducting, when either laser is turned on, and the second plurality of radiative patches 410 may be conducting when (and only when) the second laser 420 is turned on. As such, when only the first laser 415 is turned on, the antenna element may be configured to operate at a first RF frequency (e.g., it may be a bowtie antenna with dimensions suitable for transmitting or receiving the first RF frequency) and when the second laser 420 is turned on, the antenna element may be configured to operate at a second RF frequency (it may be a bowtie antenna with dimensions suitable for transmitting or receiving the second RF frequency; e.g., it may be a larger bowtie antenna suitable for transmitting or receiving at a lower RF frequency than the first RF frequency).

Figure 5A:
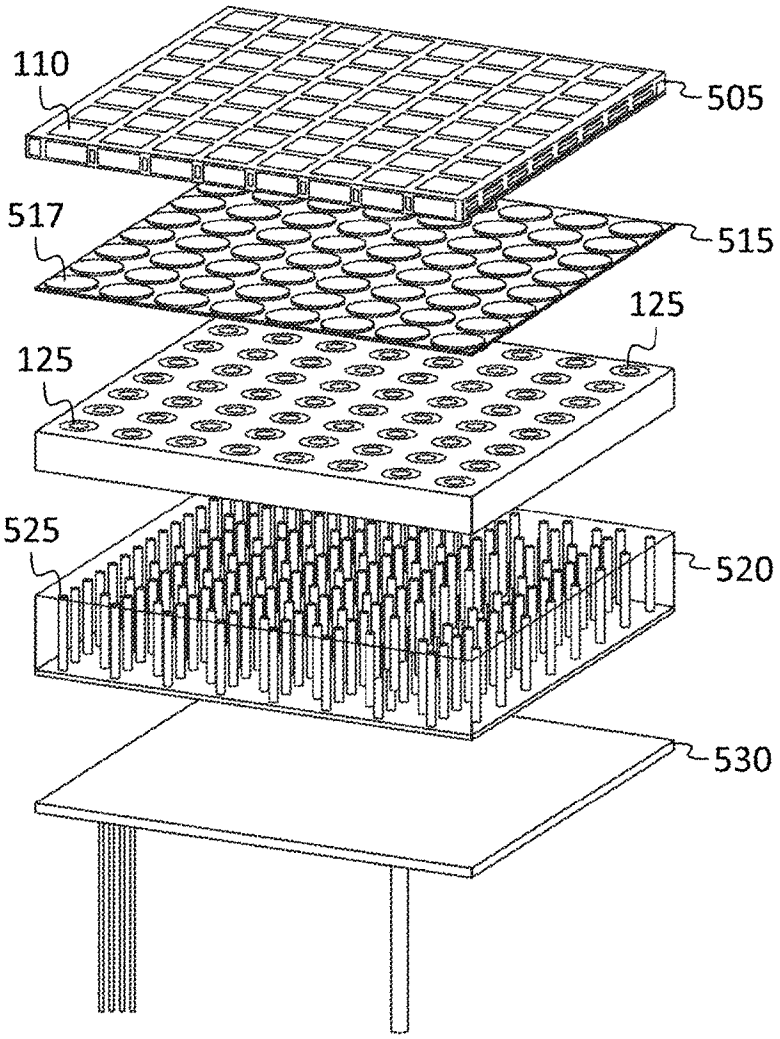
FIG. 5A is a schematic exploded perspective view of an optically configurable array antenna, according to an embodiment of the present invention.

Referring to FIG. 5A, in one embodiment (of which FIG. 5A is an exploded view), an optically configurable array antenna includes a plurality of layers stacked together. A transparent substrate 505 (which may be a glass substrate) includes a plurality of radiative patches 110 and a plurality of vias each forming a conductive path through the transparent substrate 505 to a respective radiative patch 110 of the plurality of radiative patches 110. The plurality of radiative patches 110 may be arranged on a square or rectangular grid, or on an arbitrary grid, e.g., a triangular grid. The vias may extend all the way through the transparent substrate 505 to contact the photo-conductive patches that are laser illuminated on the transparent substrate 505. This configuration may reduce the likelihood that heating may cause feedpoint contact failure. The transparent substrate 505 may be flexible glass that may be thin, with the photoconductive material (e.g., doped silicon) attached to the glass. The shapes of the radiative patches 110 on the upper layer may be arbitrary geometric shapes. Circular radiative patches 110 may be more readily fabricated, and rectangular and square radiative patches 110 may have superior coupling performance. Coupling between the radiative patches 110 may decrease the resonant frequency of the antenna element, or turn on more array elements at a different resonant frequency of the array. A microlens array 515 below the transparent substrate 505 directs light from a plurality of lasers 125 through the transparent substrate 505 and onto the plurality of radiative patches 110. The microlens array 515 may be formed on a layer of silicon dioxide $SiO_2$ and the microlenses 517 of the microlens array 515 may also be composed of silicon dioxide. The lasers 125 are arranged in an array below the microlens array 515, each laser 125 being configured, when turned on, to illuminate, through a respective microlens of the microlens array 515, a respective radiative patch 110. The lasers 125 may be vertical cavity surface emitting lasers (VCSELs) fabricated on a single chip. Whereas the embodiments of FIGS. 2 and 3 illuminate through a grating, the array in FIG. 5A uses a laser to microlens to illuminate the photo-conductive material layer.

A nonconductive substrate 520 below the array of lasers 125 includes a plurality of spring-loaded pins 525, each extending through the nonconductive substrate. The nonconductive substrate 520 may be composed of DUROID™ or another material including polytetrafluoroethylene (PTFE). An integrated circuit 530 (e.g., an application specific integrated circuit (ASIC)) below the nonconductive substrate 520 may include a plurality of laser drive circuits, each configured to turn on or off a respective laser 125 (by turning on or off a respective drive current to the respective laser 125). The integrated circuit 530 may also include a plurality of transmit receive modules (TR modules), each being configured (e.g., including a power amplifier or a low noise amplifier or both, with suitable transmit/receive switches) to provide drive current for a respective radiative patch 110, or to receive and amplify a signal from the respective radiative patch 110. The integrated circuit 530 may be connected to the array of lasers 125 and to the radiative patches 110 through the spring-loaded pins 525. Each conductive path may also include one or more vias. For example, the conductive path from the integrated circuit 530 to one of the lasers may include a spring-loaded pin 525, and a via through the chip on which the lasers 125 are fabricated. The conductive path from the integrated circuit 530 to one of the radiative patches 110 may include a spring-loaded pin 525, a via through the chip on which the lasers 125 are fabricated, a via through the silicon dioxide layer on which the microlens array 515 is formed, and a via through the transparent substrate 505.

Figure 5B:
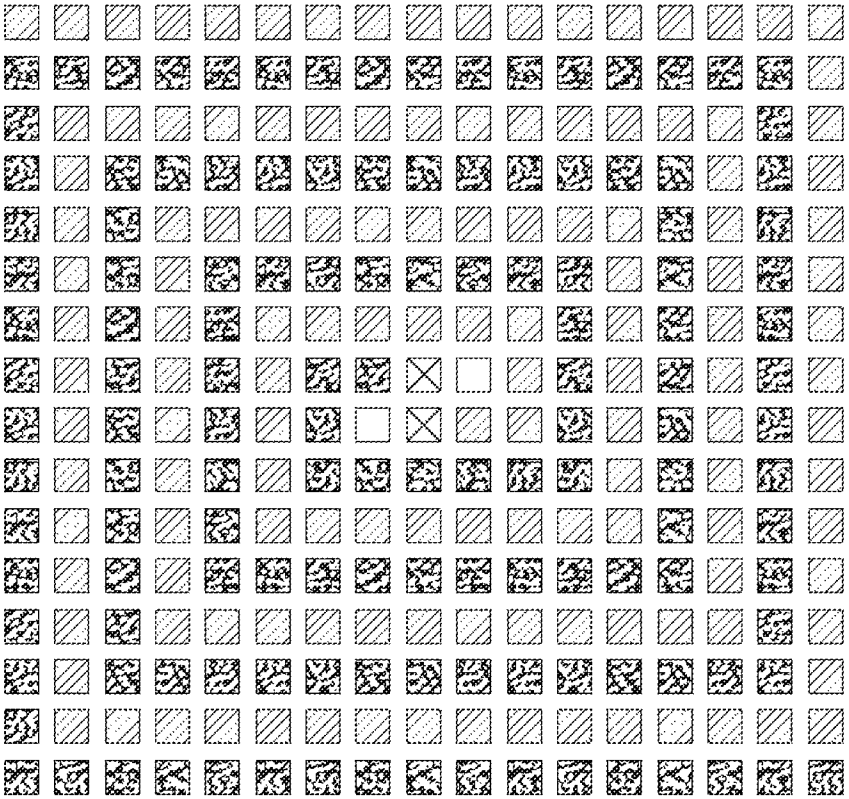
FIG. 5B is a schematic plan view of an optically configurable array antenna, according to an embodiment of the present invention.
Figure 5C:
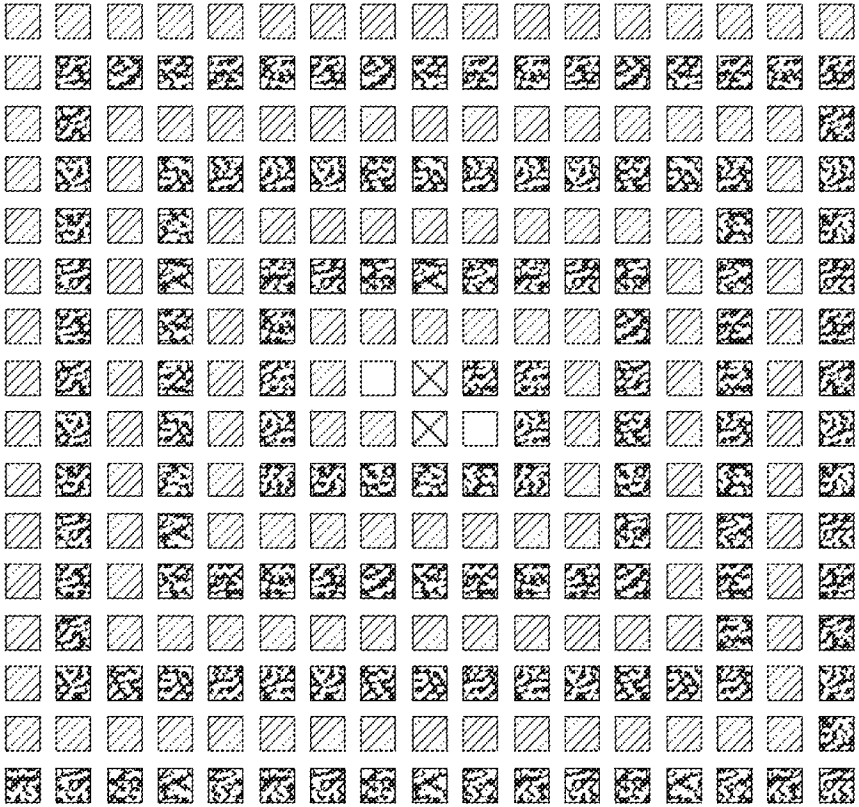
FIG. 5C is a schematic plan view of an optically configurable array antenna, according to an embodiment of the present invention.
Figure 5D:
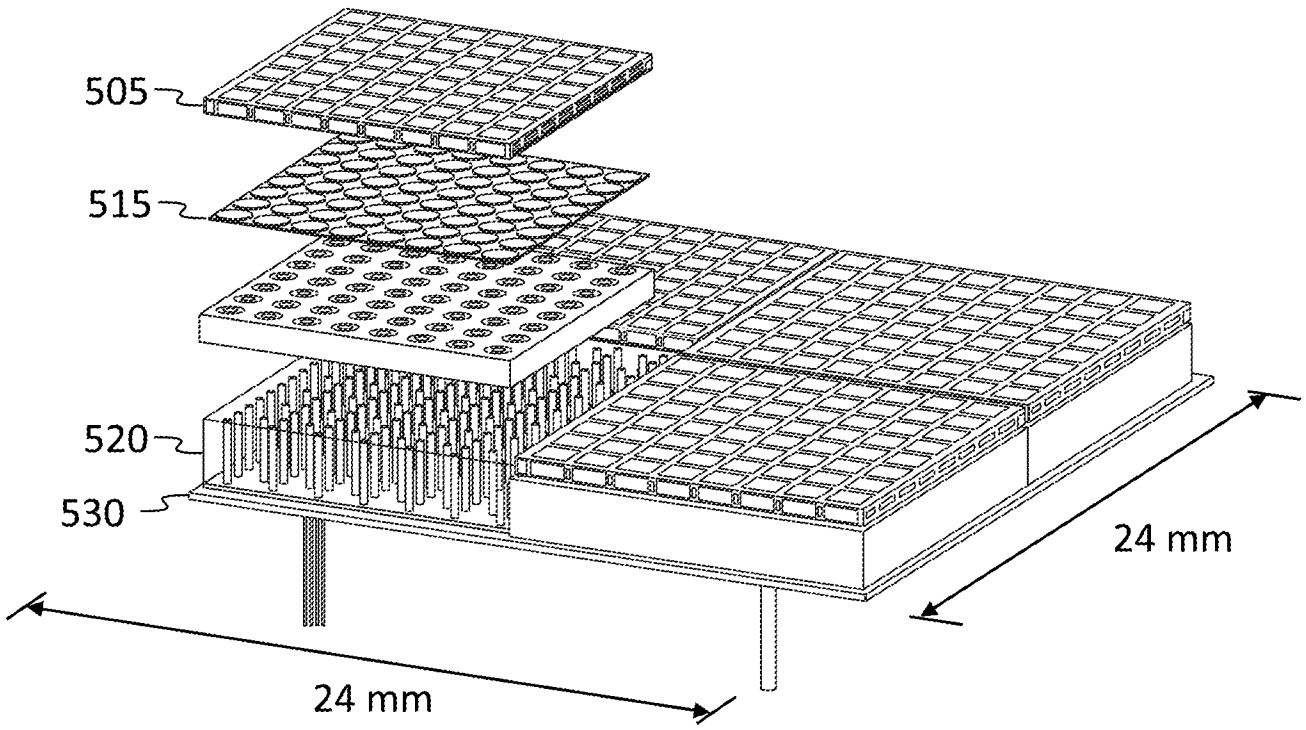
FIG. 5D is a schematic partially exploded perspective view of an optically configurable array antenna, according to an embodiment of the present invention.

Referring to FIGS. 5B and 5C, the embodiment of FIG. 5A may be configured, for example, as a spiral antenna producing (or receiving) right circularly polarized electromagnetic waves or as a spiral antenna producing (or receiving) left circularly polarized electromagnetic waves. The center two pixels or squares may be metallic in order to solve a transmit problem, in which heat is generated and the connections may fall off of the substrate. FIGS. 5B and 5C also show how this technique can fire up arbitrary wideband antennas such as the right hand circularly polarized and the left hand circularly polarized elements shown in FIGS. 5B and 5C. In some embodiments, referring to FIG. 5D, multiple instances of the assembly of FIG. 5A may be tiled together to form an arbitrarily large optically controllable array antenna.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present. As used herein, the term "major component"

means a component constituting at least half, by weight, of a composition, and the term "major portion", when applied to a plurality of items, means at least half of the items.

Although limited embodiments of an optically-activated array utilizing photonic integrated circuits have been specifically described and illustrated herein, many modifications and variations will be apparent to those skilled in the art. Accordingly, it is to be understood that an optically-activated array utilizing photonic integrated circuits employed according to principles of this invention may be embodied other than as specifically described herein. The invention is also defined in the following claims, and equivalents thereof.

What is claimed is:

1. A photonic integrated circuit, comprising:

a plurality of antenna elements, an element of the plurality of antenna elements having an electrical port and comprising:

a first laser configured to produce laser light of a first wavelength; and a first radiative patch conditionally connected to the electrical port and connected, by an optical connection, to the laser, the first radiative patch comprising, as a major component, a semiconductor material configured to be conductive when illuminated by light having the first wavelength, and to be nonconductive when not illuminated, the first radiative patch being configured, when conductive, to convert an electric signal received at the electrical port to radiated electromagnetic waves, or to convert received electromagnetic waves to an electrical signal at the electrical port.

2. The photonic integrated circuit of claim 1, wherein:

the optical connection comprises a waveguide coupled to an optical output of the first laser, and the first radiative patch is on, and parallel to, a first portion of the waveguide.

3. The photonic integrated circuit of claim 2, wherein the first portion of the waveguide comprises a grating configured to reflect light out of a plane of the waveguide and toward the patch.

4. The photonic integrated circuit of claim 2, further comprising a photonic switch on the waveguide, the photonic switch being configured to conditionally connect the first radiative patch to the electrical port.

5. The photonic integrated circuit of claim 4, wherein the photonic switch comprises a conditionally conductive path comprising, as a major component, a semiconductor material configured to be conductive when illuminated by light having the first wavelength, and nonconductive when not illuminated.

6. The photonic integrated circuit of claim 2, further comprising a photonic coupler on the waveguide, the photonic coupler being configured to conditionally connect the first radiative patch to the electrical port, wherein the photonic coupler comprises a conditionally conductive path comprising, as a major component, a semiconductor material configured to be conductive when illuminated by light having the first wavelength, and nonconductive when not illuminated.

7. The photonic integrated circuit of claim 1, further comprising a second radiative patch, the first radiative patch and the second radiative patch together forming a bowtie antenna.

8. The photonic integrated circuit of claim 1, further comprising:

a second laser configured to produce laser light of a second wavelength; and a second radiative patch conditionally connected to the electrical port, the second radiative patch comprising, as a major component, a semiconductor material configured to be conductive when illuminated by light having the second wavelength, and to be nonconductive when:

illuminated by light having the first wavelength, or not illuminated.

9. The photonic integrated circuit of claim 8, further comprising a third radiative patch and a fourth radiative patch, wherein:

the first radiative patch and the third radiative patch form, when conductive, a bowtie antenna of a first size, and the first radiative patch, the second radiative patch, the third radiative patch, and the fourth radiative patch form, when conductive, a bowtie antenna of a second size larger than the first size.

10. A stacked antenna comprising:

a first array antenna comprising a first photonic integrated circuit according to claim 1; and a second array antenna comprising a second photonic integrated circuit according to claim 1, the second array antenna being stacked parallel to the first array antenna.

11. The stacked antenna of claim 10, wherein the first array antenna is configured to operate at a first frequency and the second array antenna is configured to operate at a second frequency, higher than the first frequency.

12. The stacked antenna of claim 11, further comprising a ground plane, parallel to the first array antenna and to the second array antenna.

13. The stacked antenna of claim 12, wherein:

a separation between the ground plane and the first array antenna is one quarter of a wavelength corresponding to the first frequency, and a separation between the ground plane and the second array antenna is one quarter of a wavelength corresponding to the second frequency.

* * * * *